US006805508B2

(12) United States Patent
Castleberry

(10) Patent No.: US 6,805,508 B2
(45) Date of Patent: Oct. 19, 2004

(54) SKEW-CORRECTING MEDIA DELIVERY SYSTEM AND METHOD

(75) Inventor: Jeffery Castleberry, Underwood, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 74 days.

(21) Appl. No.: 10/113,150

(22) Filed: Mar. 28, 2002

(65) Prior Publication Data

US 2003/0184635 A1 Oct. 2, 2003

(51) Int. Cl.[7] ..... B41J 11/42

(52) U.S. Cl. ..... 400/579; 400/582; 400/596; 271/233; 399/364

(58) Field of Search ..... 271/227, 233; 400/578, 579, 582, 596; 399/364

(56) References Cited

U.S. PATENT DOCUMENTS 4,350,332 A * 9/1982 Knight ..... 271/188
4,550,902 A * 11/1985 Godlewski ..... 271/10.02
4,872,026 A 10/1989 Rasmussen et al.
5,178,379 A * 1/1993 Edwards et al. ..... 271/189
5,401,012 A * 3/1995 Taruki ..... 271/10.01
5,577,719 A * 11/1996 Nicoll ..... 271/227
5,615,872 A * 4/1997 Mochimaru ..... 271/3.14
5,624,196 A 4/1997 Jackson et al.
5,851,008 A * 12/1998 Dilanchian et al. ..... 271/4.07
6,042,109 A 3/2000 Klausbruckner
6,092,799 A * 7/2000 Koike ..... 271/3.02
6,241,242 B1 6/2001 Munro
6,307,614 B1 10/2001 Gaarder et al.

FOREIGN PATENT DOCUMENTS

EP 473884 A1 * 3/1992 ..... B65H/9/16

* cited by examiner

*Primary Examiner*—Ren Yan
*Assistant Examiner*—Dave A. Ghatt

(57) ABSTRACT

A skew-correcting media delivery system and method for driving media along a media path. A driver urges the media in a first direction and an opposite second direction along the media path. A substantially flat surface, which is aligned substantially perpendicular to the second direction, extends into the media path such that the trailing edge of the media operably engages the substantially flat surface when the media is urged in the second direction thereby aligning the media in the media path.

34 Claims, 4 Drawing Sheets

SKEW-CORRECTING MEDIA DELIVERY SYSTEM AND METHOD

BACKGROUND OF THE INVENTION

Media delivery systems are used in a wide variety of applications. For example, they deliver individual sheets of paper from a stack of papers through printers, copiers, and the like. Usually, these delivery systems include elongate and serpentine media paths for the media to travel down. Various driven rollers and other media movers are usually placed along the media path to operably engage the media and urge the media along the path.

Each sheet of media within the media delivery system must be appropriately aligned, or squared, with respect to the related printing, copying, or scanning mechanism. However, individual sheets of media frequently become skewed either upon entering the media delivery system or while traveling through the media path.

In many cases, these media delivery systems are expected to deliver different sized media, such as letter paper, envelopes, address labels, and note cards, equally effectively through the delivery system. Moreover, these media delivery systems are also expected to handle media having different weights and grades.

These variabilities in media sizes, weights, and grades, further increase the likelihood of an individual sheet within the media delivery system becoming inadvertently skewed. For example, some printers and copiers allow printing on both sides of a sheet of paper, a function commonly known as duplexing. The media path for such operations usually includes reversing the direction of the paper through the media path after one side of it has been printed on, and guiding the paper through a second media path that turns the paper over and re-delivers the paper to the same printing mechanism so that the second side of the paper can now be printed upon. The apparatus forming this second media path is frequently called a duplexer. These media delivery systems usually include a plurality of driven rollers along the media path to urge the paper in the desired direction along the path. However, fewer rollers operably engage smaller sized paper in the duplexer. Accordingly, unlike larger sheets of paper in the media path, this smaller sized paper tends to pivot slightly about the fewer engaging rollers, thereby becoming skewed.

SUMMARY OF THE INVENTION

The present invention is a skew-correcting media delivery system and method for driving media along a media path. A driver urges the media in a first direction and an opposite second direction along the media path. A substantially flat surface, which is aligned substantially perpendicular to the second direction, extends into the media path such that the trailing edge of the media operably engages the substantially flat surface when the media is urged in the second direction thereby aligning the media in the media path.

DETAILED DESCRIPTION

Figure 1A:
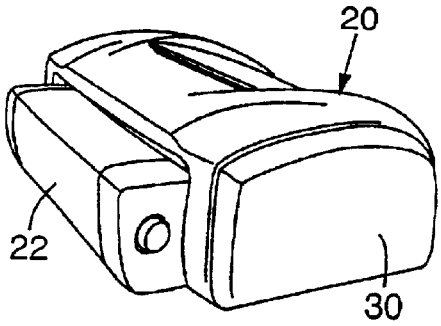
FIG. 1A is an isometric left, rear view of a printer having a detachably secured duplexer thereon in accordance with an embodiment of the media delivery system.

A media delivery system 10 with a skew correction apparatus 12 for use with a printer 20, duplexer 22, copier, and the like is disclosed in FIGS. 1A–3E. By way of example, the invention is discussed in the context of being used with a printer 20 having a duplexer 22 attached thereto.

A. Exemplar Media Path

The media delivery system 10 includes a media path 24 that preferably delivers individual sheets of media 26 from a storage area 28 to the working area of the device containing the media path. For example, as shown in FIG. 1, the device containing the media delivery system 10 is a printer 20 having a duplexer 22 detachably secured thereto.

1. Exemplar Printer

Figure 1B:
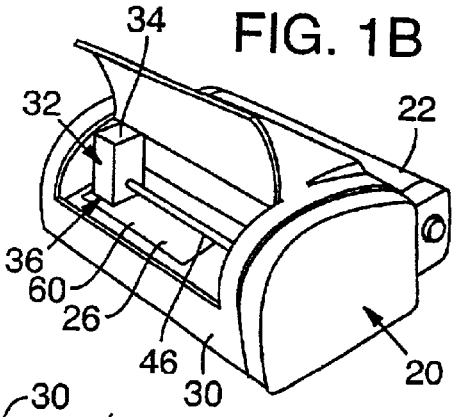
FIG. 1B is an isometric right, front view of the printer having a detachably secured duplexer thereon of FIG. 1A and having an access door open to show detail therein.

As best shown in FIG. 1B, an inkjet printer 20 preferably includes a chassis 30, a media delivery system 10 for supplying sheets of media 26 to the printer 20, and a movable print carriage 32 for moving one or more printheads 34 relative to the sheet of media 26 at a print zone 36. The sheets of media 26 may be any type of suitable sheet material, such as paper, card-stock, transparencies, mylar, foils, and the like, but for convenience, the illustrated embodiment is described using paper as the sheet of media. The media delivery system 10 moves the sheet of media into the print zone 36 from a feed tray 40 along a print media path 42, using a series of motor-driven rollers or the like, here print roller 44 is shown.

In the print zone 36, the sheets of media 26 receive ink from a printhead 34. Each printhead 34 has a bottom surface comprising an orifice plate with a plurality of nozzles formed therethrough in a manner well known to those skilled in the art. The illustrated printheads 34 are thermal inkjet printheads, although other types of printheads may be used, such as piezoelectric printheads. The printheads 34 typically include a plurality of resistors that are associated with the nozzles. Upon energizing a selected resistor, a bubble of gas is formed ejecting a droplet of ink from the nozzle and onto a sheet of media 26 in the print zone 36 under the nozzle.

The printheads 34 are transported by the print carriage 32, which may be driven by a conventional drive belt/pulley and motor arrangement (not shown) along a guide rod 46. The guide rod 46 defines a scanning direction or scanning axis along which the printheads 34 traverse over the print zone 36. The printheads 34 selectively deposit one or more ink droplets on a print media page located in the print zone 36 in accordance with instructions received via a conductor strip from a printer controller (not shown), such as a microprocessor which may be located within chassis 30.

The controller may receive an instruction signal from the microprocessor based on sensors 50 along the media path 24, and from a host device (not shown). For example, sensors can determine the size of a particular sheet of media 26 within the media path 24 and activate selected driven rollers and the like in one of two possible directions accordingly to drive the detected sheet of media 26 through the system.

The printhead carriage motor (not shown) and the media delivery system drive motor (not shown) operate in response to the printer controller, which may operate in a manner well known to those skilled in the art. The printer controller may also operate in response to user inputs provided through a keypad (not shown). A monitor coupled to a host computer may be used to display visual information to an operator, such as the printer status or a particular program being run on the computer. Personal computers, their input devices, such as a keyboard and/or a mouse device, and monitors are all well known to those skilled in the art.

2. Exemplar Duplexer

Figure 2A:
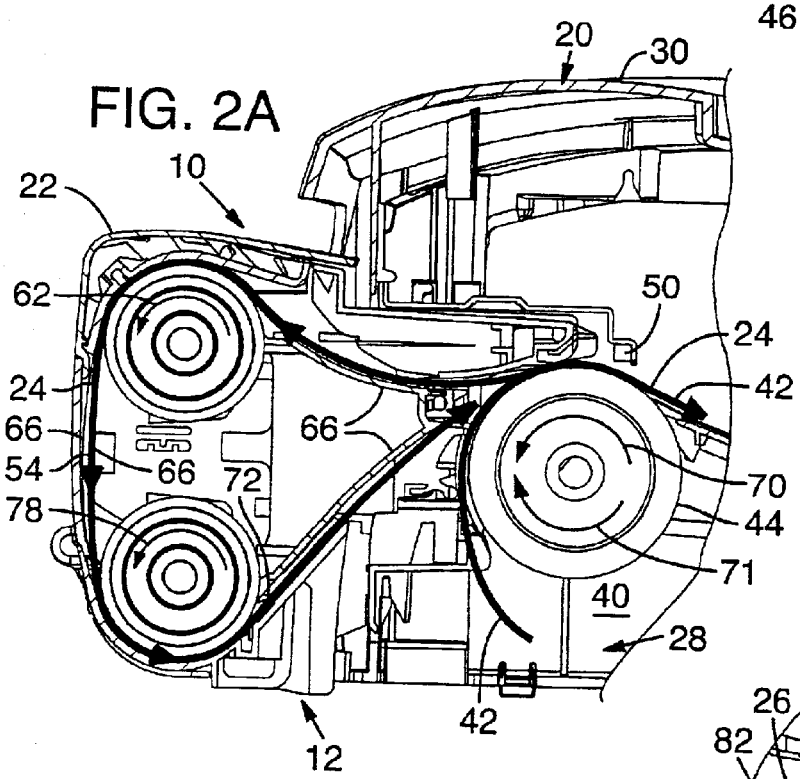
FIG. 2A is an enlarged, section view of the printer and duplexer of FIG. 1 showing a possible media path in accordance with an embodiment of the media delivery system.

As best shown in FIGS. 1A & 2A, a duplexer 22 may be detachably secured to the printer 20. The duplexer 22 creates a second media path 54 that usually includes reversing the direction of the sheet of media 26 through the print media path 42 after one side of the sheet of media 26 has been printed on, and guiding the sheet of media through the second media path 54 so that the sheet of media 26 is turned over. Then, redelivering the sheet of media 26 to the print media path 42 to allow the printing mechanism to print on the second side of the sheet of media 26. For example, after the printing mechanism prints of the first side of a sheet of media, print roller 44 is reversed by the controller so that it operates in the direction of arrow 70 (FIG. 2A), thereby driving the leading edge 60 of the paper into the second media path 54. The second media path 54 includes motor driven rollers, here first roller 62 and second roller 64 and guide surfaces 66 that operably engage the sheet of media 26 to urge it along the second media path 54.

The sheet of media 26 travels through the second media path 54 by the first and second rollers, 62, 64, respectively and thereby defining the leading edge 60 and trailing edge 68 of the sheet of media 26. As the leading edge 60 passes the second roller 64 and approaches the print roller 44, the direction of the print roller 44 is reversed by the controller so that it operates in the direction of arrow 71, thereby urging the sheet of media 26 into the printing mechanism and thereby allowing the second side of the sheet of media 26 to be printed upon.

B. Member

As shown in FIGS. 2A–2E, an embodiment of a member, such as a squaring member 72, is operably secured to a guide surface 66. The squaring member 72 has an edge 74 aligned substantially perpendicular to the media path 24 and protruding into the media path 24. Preferably, the squaring member 72 is elongate and has an arcuate outer surface 76 on the side opposite the edge. The arcuate outer surface 76 allows the leading edge 60 of the sheet of media 26 to pass by the arcuate outer surface 76 unhindered, thereby allowing the sheet of media 26 to pass the squaring member 72 when traveling in the direction of arrow 78. More preferably, the edge 74 includes a slightly recessed lip 80 therein to operably engage the trailing edge 68 of the sheet of media 26.

Figure 2B:
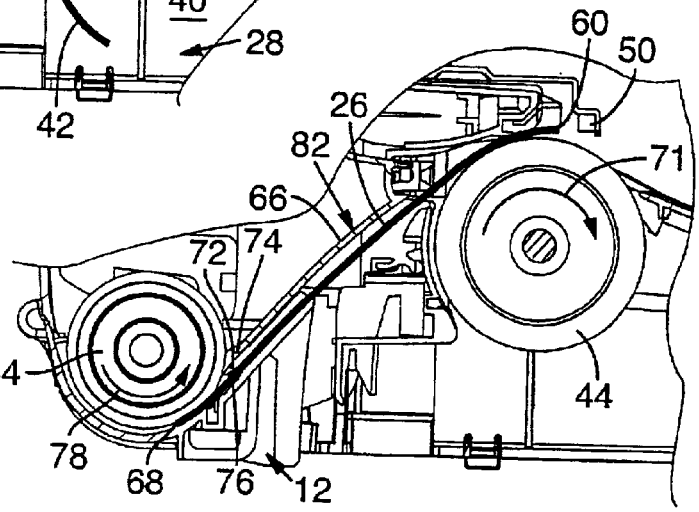
FIG. 2B is the enlarged, section view of the printer and duplexer of FIG. 2A showing a first possible position of a media in accordance with an embodiment of the media delivery system.

As best shown in FIG. 2B, the squaring member 72 is preferably secured to the guide surface 66 of the media path 24 between the second roller 64 of the duplexer 22 and the print roller 44 as shown in FIG. 2B. More preferably, the guide surface 66 between the second roller 64 and duplexer 22 is a smoothly arcuate surface leading to the edge 74 of the squaring member 72. This smoothly arcuate surface bends the sheet of media 26 such that the trailing edge 68 of the sheet of media 26 travels along the smoothly arcuate surface. Accordingly, when the sheet of media is urged toward the squaring member, the trailing edge 68 of the sheet of media 26 travels along the smoothly arcuate surface to operably engage the recessed lip 80 of the squaring member 72.

C. Use and Operation

FIGS. 2B–2E show the path of a sheet of media 26 at various possible positions as it travels through the media path 24, and FIGS. 3A–3E show schematically the same sheet of media 26 in relationship to the squaring member 72 at the same respective positions along the media path 24.

In FIG. 2B, the sheet of media 26 is traveling in a first possible position 82 from the second roller 64 of the duplexer 22 to the print roller 44. The leading edge 60 of the sheet of media 26 passes over the arcuate outer surface 76 of the squaring member 72 as it travels down the media path 24 to the print roller 44. In this view, the print roller 44 is rotating in the direction of arrow 71, and second roller 64 is rotating in the direction of arrow 78, thereby urging the sheet of media 26 past the squaring member 72. This same orientation of these components is shown schematically in FIG. 3A.

Figure 2C:
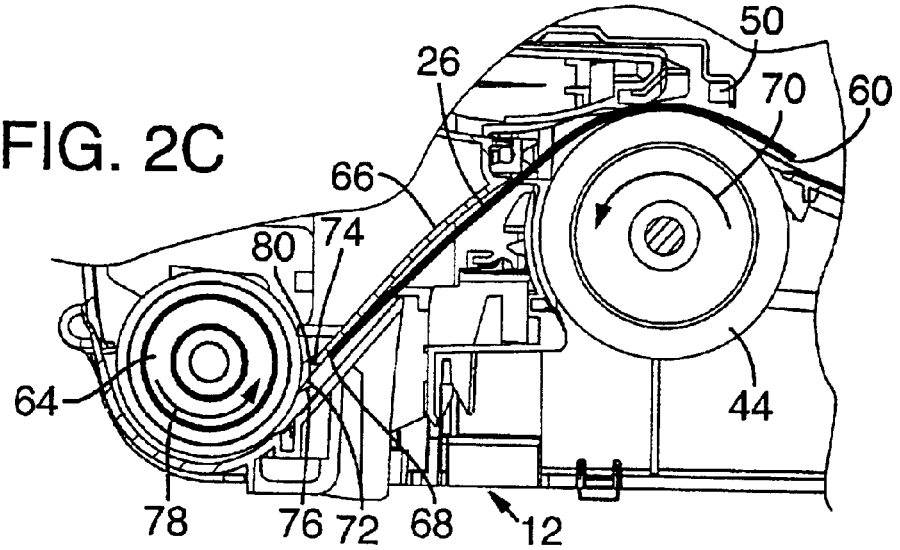
FIG. 2C is a fragmentary, enlarged, section view of the printer and duplexer of FIG. 2A showing a second possible position of the media of FIG. 2B.

In FIG. 2C, the trailing edge 68 of the sheet of media 26 has passed the squaring member 72 and the rotation direction of the print roller 44 is reversed to rotate in the direction of arrow 70, thereby driving the trailing edge 68 of the sheet of media 26 toward the squaring member 72. This same orientation of these components is shown schematically in FIG. 3B.

Figure 2D:
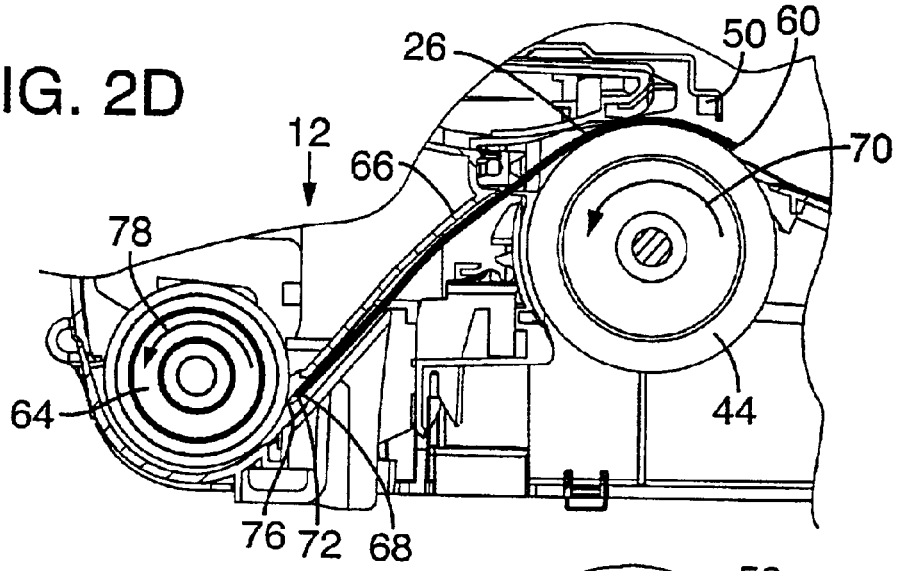
FIG. 2D is a fragmentary, enlarged, section view of the printer and duplexer of FIG. 2A showing a third possible position of the media of FIG. 2B.

In FIG. 2D, the trailing edge 68 of the sheet of media 26 contacts the edge 74 of the squaring member 72 as the print roller 44 continues to rotate in the direction of arrow 70. The trailing edge's contact with the edge 74 of the squaring member 72 urges the sheet of media 26 into alignment with the squaring member 72. This process is shown schematically in FIGS. 3B, which shows a skewed sheet of media 26 first contacting the squaring member 72, and FIG. 3D, which shows the sheet of media 26 aligning with the squaring member 72.

Shortly after the sheet of media's contact with the edge 74 of the squaring member 72 and the sheet of media 26 is aligned, the print roller 44 rotates in the direction of arrow 71 (FIG. 2E), thereby delivering the aligned sheet of media 26 to the printheads 34 for printing. This same orientation of these components is shown schematically in FIG. 3E.

D. Exemplar Control Logic.

Preferably, the printer's microprocessor includes control logic that automatically detects skewed media and activates the skew-correcting method previously described only on detected skewed media. Alternatively, the microprocessor can include logic that activates the skew-correcting method when a particularly skew-prone sheet of media 26 is presented in the media path. For example, small sized sheets of media, such as post-cards and envelopes, tend to become skewed when traveling through a printer's duplexer. The microprocessor can use sensors 50 in the printer 20 to detect when small sized media is present in the media path 24, and the microprocessor can also determine when the duplexer 22 has been activated. Accordingly, the microprocessor can subject only detected smaller-sized media to the skew-correcting method previously described, while allowing larger sheets of media passing through the media path 24, which do not tend to become skewed, to avoid being subjected to the skew-correcting method.

Figure 2E:
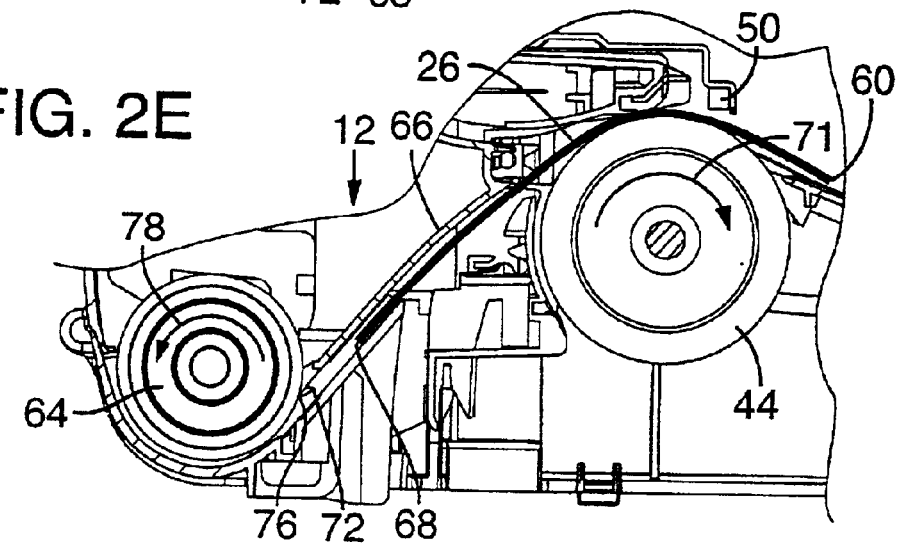
FIG. 2E is a fragmentary, enlarged, section view of the printer and duplexer of FIG. 2A showing a fourth possible position of the media of FIG. 2B.
Figure 3A:
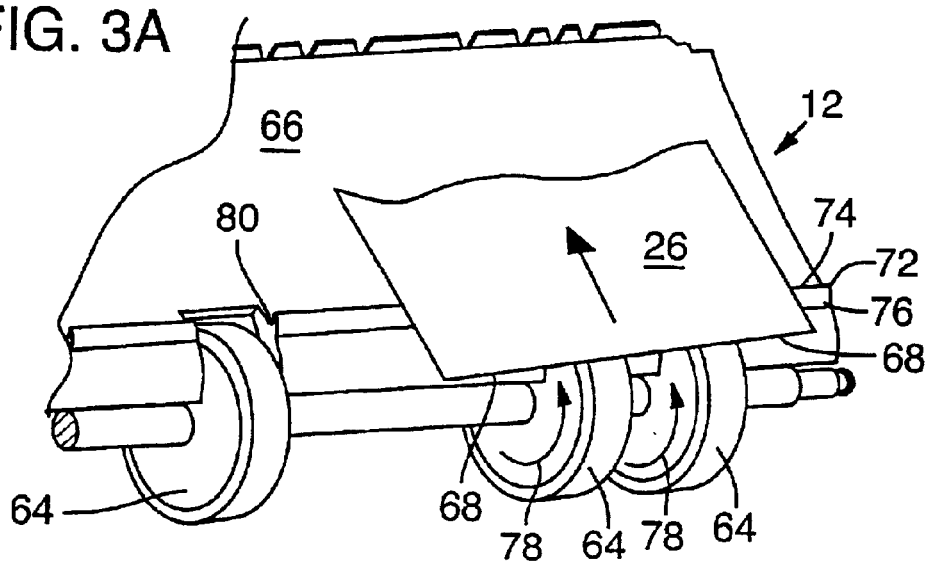
FIG. 3A is a simplified isometric diagram of the media in the first position of FIG. 2B.
Figure 3B:
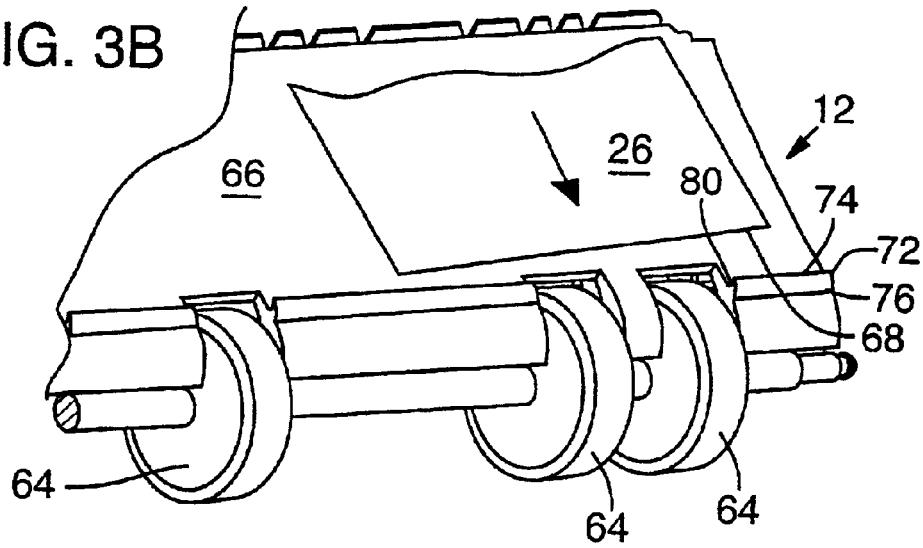
FIG. 3B is a simplified isometric diagram of the media in the second position of FIG. 2C.
Figure 3C:
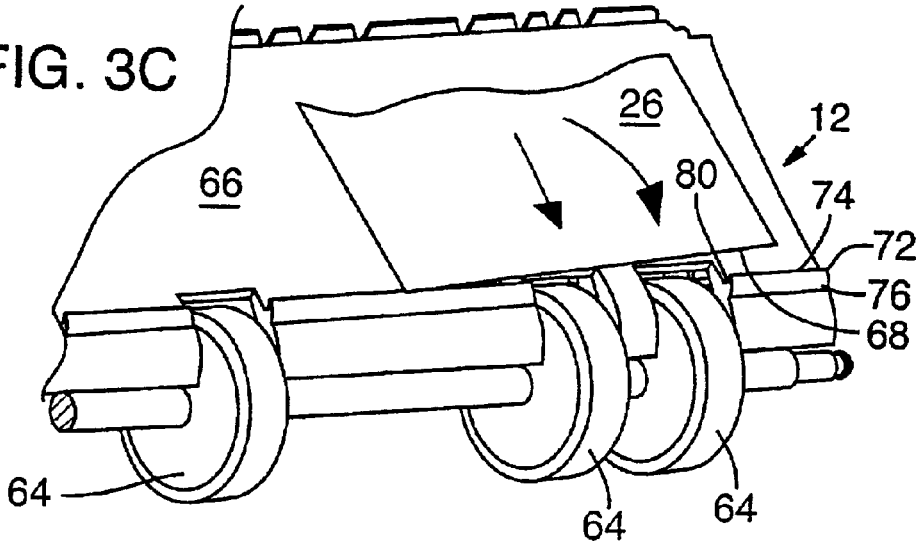
FIG. 3C is a simplified isometric diagram of the media in the third position of FIG. 2D as it first engages the squaring member.
Figure 3D:
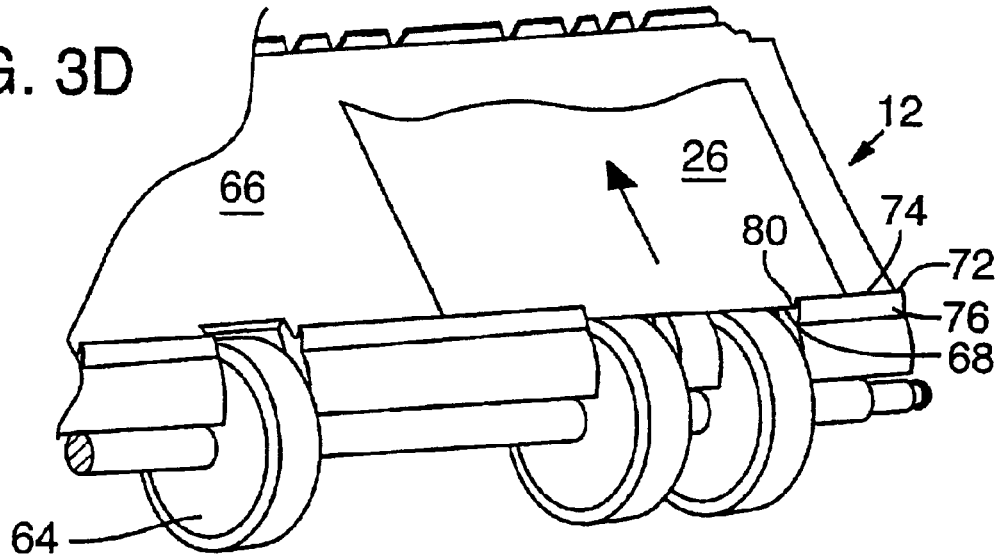
FIG. 3D is a simplified isometric diagram of the in the third position of FIG. 2D after it has operably engaged the squaring member.
Figure 3E:
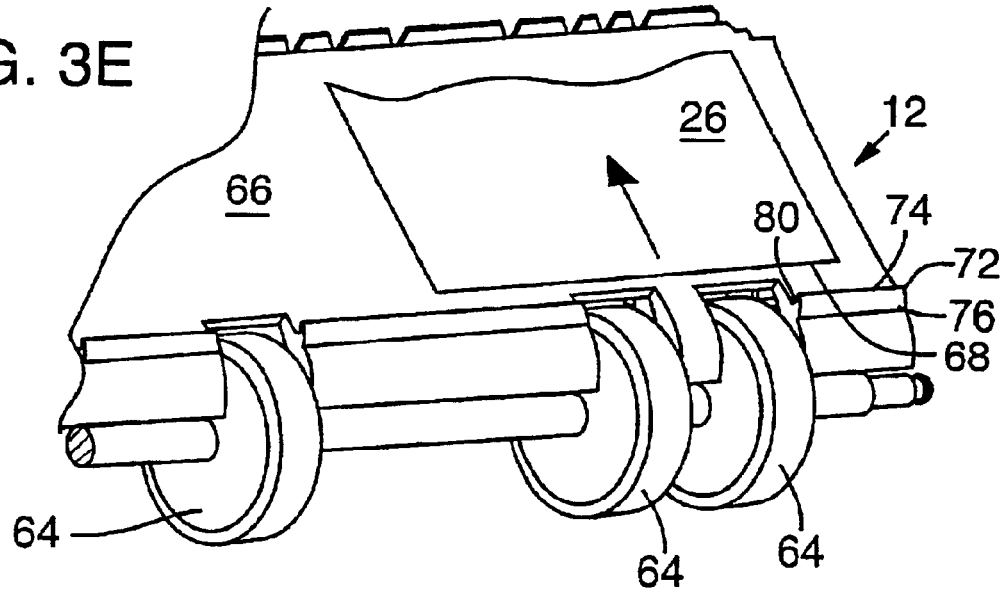
FIG. 3E is a simplified isometric diagram of the media in the fourth position of FIG. 2E.

More preferably, the control logic includes additional steps that allow the trailing edge to operably engage the edge of the squaring member 72 a plurality of times when the skew-correcting method is activated. For example, the print roller 44 can be urged in the direction of arrow 70 until the trailing edge 68 of the sheet of media operably engage the squaring member 72 as shown in FIG. 2D. Then, the print roller 44 is commanded in the direction of arrow 71 to allow the sheet of media to travel a first defined distance away from the squaring member 72 as shown in FIG. 2E. Then, the print roller 44 is commanded again in the direction of arrow 70 (FIG. 2D) to allow the sheet of media 26 to travel back toward the squaring member 72 by a second defined distance.

Preferably, the second defined distance is slightly greater than the first defined distance. For example, where the sheet of media 26 is a sheet of paper, desirable skew-correction has been achieved when the first defined distance is about 0.092 inches and the second defined distance being about 0.14 inches.

This process of advancing the sheet of media 26 away from the squaring member 72 by the first defined distance and then urging the sheet of media 26 back toward the squaring member 72 by the second defined distance may be repeated several times to ensure skew is removed from sheet of media 26. Moreover, the repeated engagement of the trailing edge 68 of the sheet of media 26 with the squaring member 72 combined with the second distance being only slightly greater than the first distance prevents the sheet of media 26 from buckling and the print roller from skidding excessively on the sheet of media 26 during the skew correcting process.

E. Alternative Embodiments

Even though the foregoing description has focused on the installation and operation of an inkjet printer 20 with a duplexer 22 attached thereto, it can be appreciated that the basic concepts of this invention will work equally well with any other type of device having a media delivery system therein, such as copiers, scanners, and the like. Moreover, the embodiments of the media delivery system have been discussed in the context of a media delivery system 10 having two separate media paths, a print media path 42 and a second media path 54. It can be appreciated by those skilled in the art that the embodiments of the media delivery system can work equally effectively in media delivery systems 10 having only one media path, or in media delivery systems having a plurality of media paths.

Thus, having here described embodiments of the media delivery system, it is anticipated that other modifications may be made thereto within the scope of the invention by individuals skilled in the art. Thus, although embodiments of the media delivery system have been described, it will be appreciated that the spirit and scope of the invention is not limited to those embodiments, but extend to the various modifications and equivalents as defined in the appended claims.

What is claimed is:

1. A method for eliminating skew in media, said media having a trailing edge and traveling in a direction of travel through a media path of a media delivery system, said method comprising:

providing a member within the media path, said member extending into the media path to define an upstream side and a downstream side, said downstream side forming an edge aligned substantially perpendicular to the direction of travel of the media, said upstream side having a substantially arcuate surface so that said media passes by said member when traveling in said direction of travel through the media path;

urging the media in a first direction along the media path such that the trailing edge of the media travels past the member;

urging the media back toward the member such that the trailing edge of the media operably engages the edge of the member.

2. The method for eliminating skew in media traveling through a media path of a media delivery system of claim 1, further including urging said media in said first direction after said trailing edge of the media has operably engaged said member.

3. The method for eliminating skew in media traveling through a media path of a media delivery system of claim 1, wherein said urging the media in a first direction along the media path step includes passing said media through a duplexer.

4. A method for eliminating skew in media, said media having a trailing edge and traveling in a direction of travel through a media path of a media delivery system, said method comprising:

providing a member within the media path, said member having an edge aligned substantially perpendicular to the direction of travel of the media;

detecting the size of the media;

urging the media in a first direction along the media path such that the trailing edge of the media travels past the member; and, urging the media back toward the member such that the trailing edge of the media operably engages the edge of the member if a predetermined size of the media is determined.

5. The method for eliminating skew in media of claim 4, wherein said media delivery system is secured within a printer and said media path has a first path and a duplexer path, said sheet of media has a first and second surface and said first surface is initially positioned to be printed on by the printer when in the first path and further including the step of:

passing said media though the duplexer path so that the sheet of media is returned to the media path with the second surface positioned to be printed upon by the printer.

6. The method for eliminating skew in media of claim 5, wherein said member extends into said duplexer path.

7. The method for eliminating skew in media of claim 5, wherein said printer is an inkjet printer.

8. The method for eliminating skew in media of claim 4, wherein said member extends into the media path to define an upstream side and a downstream side, said downstream side forming an edge aligned substantially perpendicular to the direction of travel of the media.

9. The method for eliminating skew in media of claim 8, wherein said upstream side has a substantially arcuate surface so that said media passes by said member when traveling in said direction of travel though the media path.

10. The method for eliminating skew in media of claim 8, wherein said member extends into said duplexer path.

11. A method for eliminating skew in media, said media having a trailing edge and traveling in a direction of travel through a media path of a media delivery system, said method comprising:

providing a member within the media path, said member having an edge aligned substantially perpendicular to the direction of travel of the media;

detecting the skew of the media;

urging the media in a first direction along the media path such that the trailing edge of the media travels past the member;

urging the media back toward the member such that the trailing edge of the media operably engages the edge of the member if a predetermined skew of the media is determined.

12. The method for eliminating skew in media of claim 11, wherein said media delivery system is secured within a printer and said media path has a first path and a duplexer path, said sheet of media has a first and second printing surface and said first printing surface is initially positioned to be printed on by the printer when in the first path and further including the step of:

passing said media though the duplexer path so that the sheet of media is returned to the media path with the second surface positioned to be printed upon by the printer.

13. The method for eliminating skew in media of claim 11, wherein said member extends into the media path to define an upstream side and a downstream side, said downstream side forming an edge aligned substantially perpendicular to the direction of travel of the media.

14. The method for eliminating skew in media of claim 13, wherein said upstream side has a substantially arcuate surface so that said media passes by said member when traveling in said direction of travel though the media path.

15. A method for eliminating skew in media, said media having a trailing edge and traveling in a direction of travel through a media path of a media delivery system, said method comprising:

providing a member within the media path, said member having an edge aligned substantially perpendicular to the direction of travel of the media;

urging the media in a first direction along the media path such that the trailing edge of the media travels past the member;

urging the media back toward the member such that the trailing edge of the media operably engages the edge of the member;

urging the media in the first direction along the media path such that the trailing edge of the media travels away from the member by a first defined distance; and, urging the media back toward the member so that the media travels toward the member by a second defined distance and operably engages the edge of the member.

16. The method for eliminating skew in media traveling through a media path of a media delivery system of claim 15, wherein said second defined distance is slightly greater than said first defined distance.

17. The method for eliminating skew in media traveling through a media path of a media delivery system of claim 15, wherein after the step of urging the media back toward the member so that the media travels toward the member by a second defined distance and operably engages the edge of the member, further including the steps of:

urging the media in the first direction along the media path such that the trailing edge of the media travels away from the member by a third defined distance; and urging the media back toward the member so that the media travels toward the member a fourth defined distance and operably engages the edge of the member.

18. The method for eliminating skew in media traveling through a media path of a media delivery system of claim 17, wherein said first and third defined distances are substantially the same, and said second and fourth defined distances are substantially the same.

19. The printer for printing on media of claim 15, wherein said media has a first and second printing surface, and further including a duplexer operably secured thereto, said media path including a print media path and a second media path, said second media path operably engaging said print media path such that when the travels along said second media path said sheet of media is rotated so said second printing surface can operably engage said printhead along said print media path.

20. The printer for printing on media of claim 19, wherein said duplexer is detachably secured to said printer.

21. The printer for printing on media of claim 19, wherein said member is operably secured along said second media path.

22. A printer for printing on media, said media having a leading edge and a trailing edge, said printer comprising:

a printhead for printing on the media at a print zone;

a media delivery system for transporting the media along a media path to the print zone, said media delivery system including at least one driver for urging the media in a first direction along the media path, and an opposite second direction;

a member extending into the media path thereby defining an upstream side and a downstream side, said downstream side forming a substantially flat edge aligned substantially perpendicular to the second direction; said trailing edge of said media operably engaging said edge of said member when said driver urges said media in said second direction thereby aligning said media in said media path, wherein said upstream side includes an arcuate surface that allows the leading edge of said media to pass unhindered by said member when said driver urges said media in said first direction.

23. The printer for printing on media of claim 22, wherein said member is elongate and has a lip for operably engaging the trailing edge of said media.

24. The printer for printing on media of claim 22, further including a controller for commanding the driver to repeatedly urge the trailing edge of the media against and away from the edge of the member.

25. A printer for printing on media, said media having a leading edge and a trailing edge, said printer comprising:

a printhead for printing on the media at a print zone;

a sensor for detecting the size of the media;

a media delivery system for transporting the media along a media path to the print zone, said media delivery system including at least one driver for urging the media in a first direction along the media path, and an opposite second direction;

a member extending into the media path, said member having an edge aligned substantially perpendicular to the second direction; said trailing edge of said media operably engaging said edge of said member when said driver urges said media in said second direction thereby aligning said media in said media path; and, said driver urges said media in said second direction if a predetermined size of the media is determined.

26. A printer for printing on media, said media having a leading edge and a trailing edge, said printer comprising:

a printhead for printing on the media at a print zone;

a sensor for detecting the skew of the media;

a media delivery system for transporting the media along a media path to the print zone, said media delivery system including at least one driver for urging the media in a first direction along the media path, and an opposite second direction;

a member extending into the media path, said member having an edge aligned substantially perpendicular to the second direction; said trailing edge of said media operably engaging said edge of said member when said driver urges said media in said second direction thereby aligning said media in said media path; and, said driver urges said media in said second direction if a predetermined skew of the media is determined.

27. A skew-correcting media delivery system for driving media along a media path, the media having a trailing edge, said skew-correcting media delivery system comprising:

at least one driver for urging the media in a first direction along the media path, and an opposite second direction;

a substantially flat surface extending into the media path and aligned substantially perpendicular to the second direction; said trailing edge of said media operably engaging said substantially flat surface when said driver urges said media in said second direction thereby aligning said media in said media path; and control means for commanding the driver to repeatedly urge the trailing edge of the media against and away from the substantially flat surface.

28. The skew-correcting media delivery system of claim 27, wherein said substantially flat surface has a lip for operably engaging the trailing edge of said media.

29. The skew-correcting media delivery system of claim 28, wherein said substantially flat surface has an opposite arcuate surface that allows the leading edge of said media to pass unhindered thereby allowing the media to pass by said substantially flat surface when said media is traveling in said first direction.

30. The skew-correcting media delivery system of claim 28, wherein said media delivery system is installed in a printer.

31. The skew-correcting media delivery system of claim 30, wherein said printer includes a duplexer.

32. A skew-correcting media delivery system for driving media along a media path, the media having a trailing edge, said skew-correcting media delivery system comprising:

driving means for urging the media in a first direction along the media path, driving means for urging the media in an opposite second direction along the media path;

squaring means extending into the media path for operably engaging the trailing edge of the media when the driving means urges the media in the opposite second direction, wherein said media has a first side and a second side, and further including means for turning the media within the media path from the first side to the second side and wherein the media path include a first media path and a second media path, and said squaring means and said means for turning the media are operably received within said second media path.

33. The skew-correcting media delivery system of claim 32, wherein said driving means includes a drive roller for engaging the media, and said squaring means includes an elongate member having an edge aligned substantially perpendicular to the media path.

34. The skew-correcting media delivery system of claim 32, further including control means for commanding the driving means to repeatedly urge the trailing edge of the media against and away from the squaring means.

* * * * *